United States Patent [19]

Waln

[11] 4,096,802

[45] Jun. 27, 1978

[54] MOTION-INDUCED STIMULI INITIATION SYSTEM

[75] Inventor: Garry L. Waln, Sunnyvale, Calif.

[73] Assignee: The United States of America as represented by the Secretary of the Navy, Washington, D.C.

[21] Appl. No.: 745,131

[22] Filed: Nov. 26, 1976

[51] Int. Cl.[2] ..... F42C 11/06

[52] U.S. Cl. ..... 102/49.5; 102/215

[58] Field of Search ..... 102/49.5, 49.7, 70.2 R, 102/70.2 A

[56] References Cited

U.S. PATENT DOCUMENTS

| | | | |
|---|---|---|---|
| 3,153,520 | 10/1964 | Morris | 102/70.2 R |
| 3,338,166 | 8/1967 | Litman et al. | 102/70.2 R |
| 3,890,901 | 6/1975 | Anderson et al. | 102/70.2 R |
| 4,013,012 | 3/1977 | Giattino | 102/70.2 R |

*Primary Examiner*—Verlin R. Pendegrass

*Attorney, Agent, or Firm*—R. S. Sciascia; Charles D. B. Curry; Francis I. Gray

[57] ABSTRACT

A motion-induced stimuli initiation system for actuating various missile pyrotechnic devices based upon attainment of specified values of acceleration, velocity and distance after launch. Data from accelerometers are integrated to obtain velocity, the velocity data are integrated to obtain distance. Comparison of acceleration, velocity and distance with predetermined values by appropriate logic circuitry provides the signals to initiate the pyrotechnic devices.

4 Claims, 9 Drawing Figures

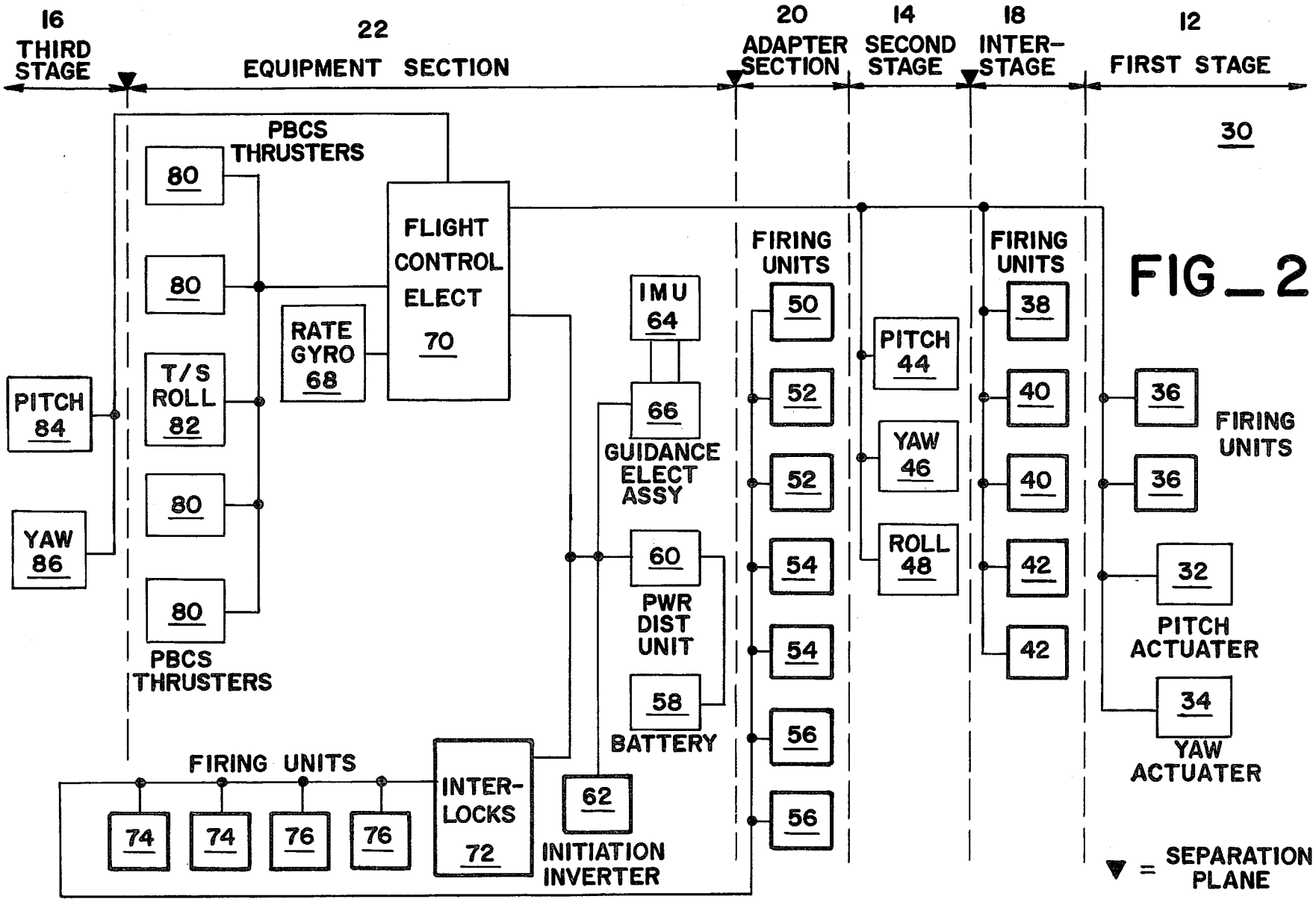
FIG_2
30
12 FIRST STAGE
18 INTER-STAGE
14 SECOND STAGE
20 ADAPTER SECTION
22 EQUIPMENT SECTION
16 THIRD STAGE
FIRING UNITS
36
36
32
PITCH ACTUATER
34
YAW ACTUATER
= SEPARATION PLANE
FIRING UNITS
38
40
40
42
42
PITCH 44
YAW 46
ROLL 48
FIRING UNITS
50
52
52
54
54
56
56
IMU 64
66
GUIDANCE ELECT ASSY
60
PWR DIST UNIT
58
BATTERY
62
INITIATION INVERTER
FLIGHT CONTROL ELECT 70
RATE GYRO 68
INTER-LOCKS 72
PBCS THRUSTERS
80
80
T/S ROLL 82
80
80
PBCS THRUSTERS
FIRING UNITS
74
74
76
76
PITCH 84
YAW 86

| | | | |
|---|---|---|---|
| FIG_3a | FIG_3b | FIG_3c | FIG_3d |

MOTION-INDUCED STIMULI INITIATION SYSTEM

BACKGROUND OF THE INVENTION

1. Field of the Invention

The present invention relates to initiation systems, amd more particularly to initiation systems using motion-induced stimuli to generate the initiation signals.

2. Description of the Prior Art

In multi-stage rocket, or missile, applications a series of pyrotechnic events occur to fire the various engine stages and to separate the various stages. In controlling pyrotechnic activities, especially in the first stages of launch, safety of ground personnel is imperative. This is even more apparent in the launch of missiles from a submerged vehicle where a premature pyrotechnic event could be catastrophic to the submerged vehicle and its crew.

Prior pyrotechnic initiation systems have been controlled by timers which start when the rocket is launched and control subsequent pyrotechnic events. However, for launch from a submerged vehicle this is unsatisfactory since the timer, once started, cannot usually be stopped.

Motion-induced stimuli have been used to a limited extent in range safety applications to assure that, if a rocket attains accelerations outside the predetermined flight profile, the rocket can be destroyed safely without impacting in a populated area. It is desired, however, that for submerged launches the rocket clear the submerged vehicle before the pyrotechnic events which could pose a danger to the crew are initiated.

SUMMARY OF THE INVENTION

Accordingly, the present invention provides a motion-induced stimuli initiation system for actuating various missile pyrotechnic devices based upon attainment of specified values of acceleration, velocity and distance after launch. Data from accelerometers are integrated to obtain velocity, and the velocity data are integrated to obtain distance. Comparison of acceleration, velocity and distance with predetermined values by appropriate logic circuitry provides the signals to initiate the pyrotechnic devices.

STATEMENT OF THE OBJECTS OF THE INVENTION

Therefore, it is an object of the present invention to provide initiation signals to missile pyrotechnic devices based upon motion-induced stimuli.

Another object of the present invention is to provide safe initiation of missile pyrotechnic devices based upon attainment of predetermined acceleration, velocity and distance values.

Other objects, advantages and novel features of the invention will become apparent from the following detailed description of the invention when considered in conjunction with the accompanying drawings wherein:

BRIEF DESCRIPTION OF THE DRAWINGS

FIG. 2 is a block diagram of an initiation system.

DESCRIPTION OF THE PREFERRED EMBODIMENT

Figure 1:
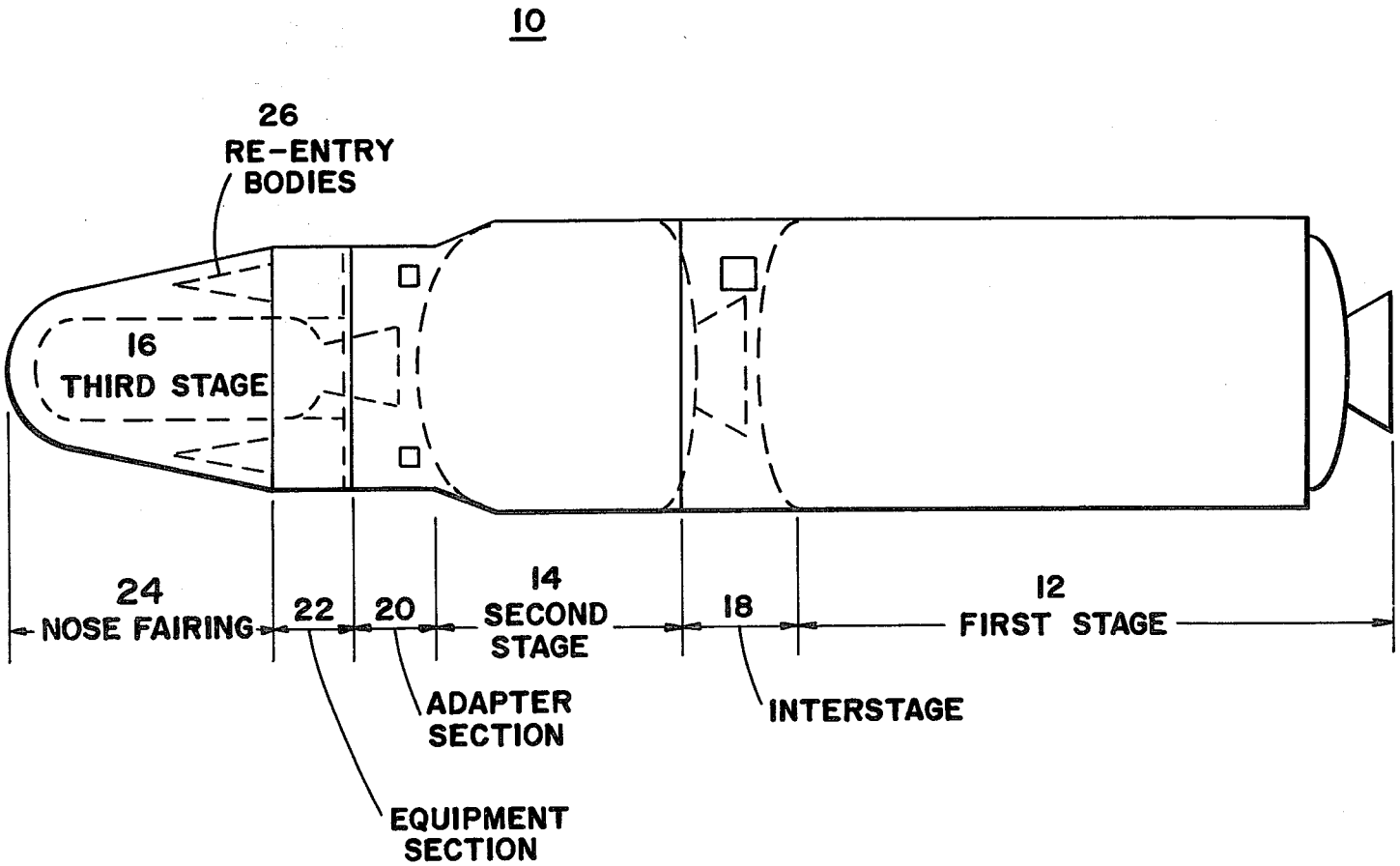
FIG. 1 is an illustration of a multi-stage missile.

Referring now to FIG. 1 a typical multi-stage missile 10 has a first stage 12 housing the rocket motor and propellants for the initial boost phase of flight, a second stage 14 housing the rocket motor and propellants for the intermediate boost phase of flight, and a third stage 16 housing the rocket motor and propellants for the final boost phase of flight. An interstage 18 connects the first stage 12 to the second stage 14, and houses the electronics required for the first stage. The interstage 18 is discarded with the first stage 12 at first staging. An adapter section 20 connects the second stage 14 to the third stage 16, and houses the electronics required for the second stage. The adapter section 20 is discarded with the second stage at second staging.

An equipment section 22 is connected to the third stage 16 and houses the electronics and control equipment required for the post-boost phase of flight. A plurality of re-entry bodies 26 are mounted on the forward portion of the equipment section 22 and are designed to return to the surface of the earth without burning up in the earth's atmosphere. A nose fairing 24 is connected to the equipment section 22 to protect the re-entry bodies 26 during powered flight through the atmosphere, and is discarded once the missile has attained an altitude where atmospheric effects are negligible. The third stage 16 is discarded from the equipment section 22 once the desired final flight trajectory is attained.

A typical initiation system 30, as shown in FIG. 2, has a pitch actuator 32 and a yaw actuator 34 to gimbal the first stage rocket motor to maintain a proper flight trajectory during the initial boost phase of flight. Redundant firing units 36 are pyrotechnic devices which initiate the thrust vector control (TVC) of the pitch and yaw actuators 32, 34.

Additional firing units 38, 40, 42 initiate ignition of the first stage rocket motor, the thrust vector control for the second stage and separation of the first stage 12 and associated interstage 18 from the second stage 14. The second stage 14 has pitch and yaw actuators 44, 46 and a roll thruster 48 to maintain the missile 10 on the proper flight trajectory during the intermediate boost phase of flight. Located in the adapter section 20 are firing units 50, 52, 54, 56 to initiate ignition of the second stage rocket motor, ejection of the nose fairing 24, the thrust vector control for the third stage and separation of the second stage 14 and associated adapter section 20 from the equipment section 22 as well as ignition of the third stage rocket motor.

Electrical power for the initiation system 30 is provided by a battery 58. The battery voltage is applied to the missile via a power distribution unit 60. An initiation inverter 62 converts the d.c. voltage to an a.c. voltage which is required as one of the inputs to the firing units. An inertial moment unit 64 provides guidance signals via a guidance electronics assembly 66, as does a rate gyro package 68, which are input to a flight control electronics package 70. The flight control electronics package 70 is a computer which generates control signals to the various control actuators and thrusters to maintain the missile on the proper flight trajectory.

An interlocks 72 provides the signals to all the firing units which initiate the various missile pyrotechnic devices. The signals are derived from motion-induced stimuli as well as digital commands from the flight control electronics package. Firing units 74, 76 to initiate the post boost control system and separation of the third stage 16 from the equipment section 22 are also located in the equipment section. Also located in the equipment section 22 are the post boost control system thrusters 80 and the third stage roll thruster 82 which also provides post boost control to the equipment section. Pitch and yaw actuators 84, 86 are located on the third stage to provide flight trajectory control during the final boost phase of flight.

Referring now to FIG. 3 the generation of the various pyrotechnic events will be described in detail. Prior to launch the missile is connected to the launching facility by one or more umbilical connectors 88 through which power is applied to the missile for ground testing, and through which the missile status is monitored. Just prior to missile launch the battery 58 is activated and power is switched from external to internal power by a switch 90 in the power distribution unit 60, applying battery power to the missile through the initiation inverter 62. The application of battery power to line 92 through a shorted connector in the umbilical connector 88 resets latching relays K1 through K5 and K7. Point A on umbilical 88 verifies application of power to line 92, point B verifies all the latching relays are reset, point C verifies DC Arm is present on line 96, and points D and E verify through a monitor 95 AC Arm is present on line 94.

The power present on line 92 inhibits any missile pyrotechnic events from occurring prior to launch. When umbilical disconnect occurs after the missile is launched and makes the first movement on its trajectory, the shorted umbilical connectors are removed from line 92, removing power to the LFM (Launch First Movement) line which provides an enabling signal to AND gates 100, 102 for the first few pyrotechnic events. One or more accelerometers 104 provide motion-induced stimuli which are used to initiate the first few pyrotechnic events. Redundancy is the rule in rocket and missile applications, since a repairman is not readily available if a malfunction occurs once the rocket or missile has been launched, thus providing increased safety and reliability. For submerged vehicle launches the initial launch impulse is a compressed fluid which propels the missile a sufficient distance so that the first stage rocket motor can be ignited without endangering the launch facility.

The output A1 of accelerometer 104 is compared in comparator 106 with a predetermined acceleration value, a1. When the acceleration reaches al, the output from comparator 106 together with LFM from innerter 98 are applied to an AND gate 108 to provide an A1′ signal which is applied to AND gate 110 together with a redundant signal A2′ derived in the same manner. The output signal 1A, 1B from AND gate 110 is applied to OR gate 112 which causes latching relay K1 to set. Setting of K1 applies the AC Arm signal to the first firing unit 36 which enables the thrust vector control system for the first stage rocket motor (TVC-1), and it also applies an enable signal to line 116. The output of OR 112 is also applied to AND gate 100 and a time delay 114. AND 100 outputs a Fire signal to the firing unit 36 and through AND gate 102 provides a DC Arm signal, which signals terminate at the end of the time delay 114 period. Thus, the first pyrotechnic event is initiated with the three signals applied simultaneously to the firing unit 36.

A1′ is also applied to OR gate 118 which latches itself so long as A1′ is present long enough to time out time delay 120. The output of OR 118 is applied to AND gate 121 along with LFM. The third input to AND 121 provides a gate time during which certain motion-induced events must occur, or they will be inhibited. LFM is delayed by time delay 142, which is 4.0 seconds in duration in one embodiment, and latches OR gate 144 which inhibits the CH Enable output of AND 121.

The CH Enable signal enables integrators 146, 148. The input to integrator 146 is the accelerometer 104 output, and the output is input to the second integrator 148. Thus, the output of integrator 146 is velocity, and the output of integrator 148 is distance. The velocity output of integrator 146 is compared in comparator 150 with two predetermined velocity values, $v1$ and $v2$ greater than $v1$. When $v1$ is achieved, but before $v2$ is achieved, AND gate 152 provides an output to AND gate 154. When $v2$ is achieved, OR gate 156 latches and inhibits further output from AND 152, thus, also inhibiting output from AND 154.

The distance output is compared in comparator 158 with $d1$ and $d2$ greater than $d1$, and when $d1$ is attained AND gate 154 provides an output pulse to latching OR gate 162, the pulse width being determined by the time of time delay 160. By using a plurality of accelerometers redundancy is achieved and the outputs of AND gates 162 are input to a solid state voting logic, Q1 through Q6 in the present embodiment, which has been enabled by line 116.

The output of the voting logic sets relays K2 and K3 to arm the destruct system, to enable the first stage rocket motor ignition firing unit 40 with the AC and DC Arm signals, and to provide DC Arm to the remaining firing units. Concurrence of distance $d1$ within velocity gate $v2 - v1$ after launch and $a1$ have been attained, and within the time interval of time delay 142 after launch, provides the safety margin so that the missile can be destroyed and/or the rocket motor ignited without danger to the submerged launch facility.

When distance $d2$ is attained comparator 158 provides a redundant output to AND gate 164 which is input to AND gate 168 to provide the Fire signal pulse for the firing unit 40, the pulse width being determined by the time of time delay 166. The Fire signal is also applied to OR gate 170 to initiate the flight timer in the flight control electronics package 70. The other input to OR 170 is a digital prelaunch command from the flight control electronics package via a command decoder 172 used to check the flight timer prior to launch.

Prior to completion of the first stage burn a second stage permissive (SSP) command from the command decoder is input to AND gate 174 along with the $a1$ acceleration signal, i.e., AND 174 outputs so long as the missile acceleration is greater than or equal to $a1$ when the SSP command is given. Relay K4 is latched, applying an enable signal via line 96′ to the logic for subsequent second stage events. Also, the AC Arm signal is applied to all remaining firing units and a DC signal is applied to one terminal of non-latching relay K6.

The Fire signal for the thrust vector control firing unit 42 for the second stage is a function of the proper burn of the first stage rocket motor as determined by the accelerometers. The $a1$ acceleration signal is input to AND gate 176 and its inversion is input to AND gate 178. When AND 176 and 178 are enabled by the SSP command, under normal conditions the acceleration 1A, 1B is greater than $a1$ and AND 176 conducts while AND 178 is cut-off. The output of AND 176 is delayed by delay line 190 for a period of time sufficient to allow for variations in the burn time of the second stage, typically 4 seconds, before being input to self-latching OR gate 192. The output of OR 192 enables AND gate 194 so that, when A1 decays to below *a*1, AND 178 outputs through time delay 196 to AND 194. The output of AND 194 is input to AND gate 200, as is the inverted output delayed by time delay 198, to provide the Fire signal for TVC-2.

When the accelerometer values drop below *a*2 as determined by comparators 204, AND gates 180 provide an input to AND gate 202 which is enabled by the trailing edge of the TVC-2 Fire signal from time delay 198. The output of AND 202 is the Fire signal for separating the first stage (SEP-1) and for ignition of the second stage rocket motor (IGN-2).

If the first stage rocket motor burns out prematurely before the SSP command enables AND 176, 1A, 1B will be less than *a*1 already and the second stage events will not occur. Or if the first stage rocket motor burns excessively long, or if third stage events occur prematurely, AND 202 is inhibited by the third stage thrust vector control command (TVC-3) from the flight control computer 70.

The remaining missile events are the result of digital commands from the flight control computer 70 which are decoded by the data decoder 172 and applied to AND gates in sequence to (1) activate the re-entry body batteries through non-latching relays K6, (2) eject the nose fairing once the atmosphere has been cleared, (3) start the re-entry body timers, (4) initiate third stage thrust vector control while simultaneously enabling the remaining missile events by latching relay K5, (5) provide second stage separation and third stage rocket motor ignition, (6) enable the post boost control system, and (7) provide third stage separation.

The final phase of the missile flight consists of the equipment section 22 acting as a launch platform for the re-entry bodies 26 which will freefall to an impact point. Data is transferred to each re-entry body 26 after being shaped by pulse shaper 222. The shaped data passes through an enable switch 224 to a particular one of the re-entry bodies 26 according to the particular one selected by command to enable AND gate 214. The launching of the re-entry bodies 26 is enabled by a command (IFS) which latches relay K-7 to supply AC power to the set terminal of relay K-8. The re-entry bodies 26 are then launched sequentially by Set/Reset commands which alternately set and reset relay K-8.

Figure 3A:
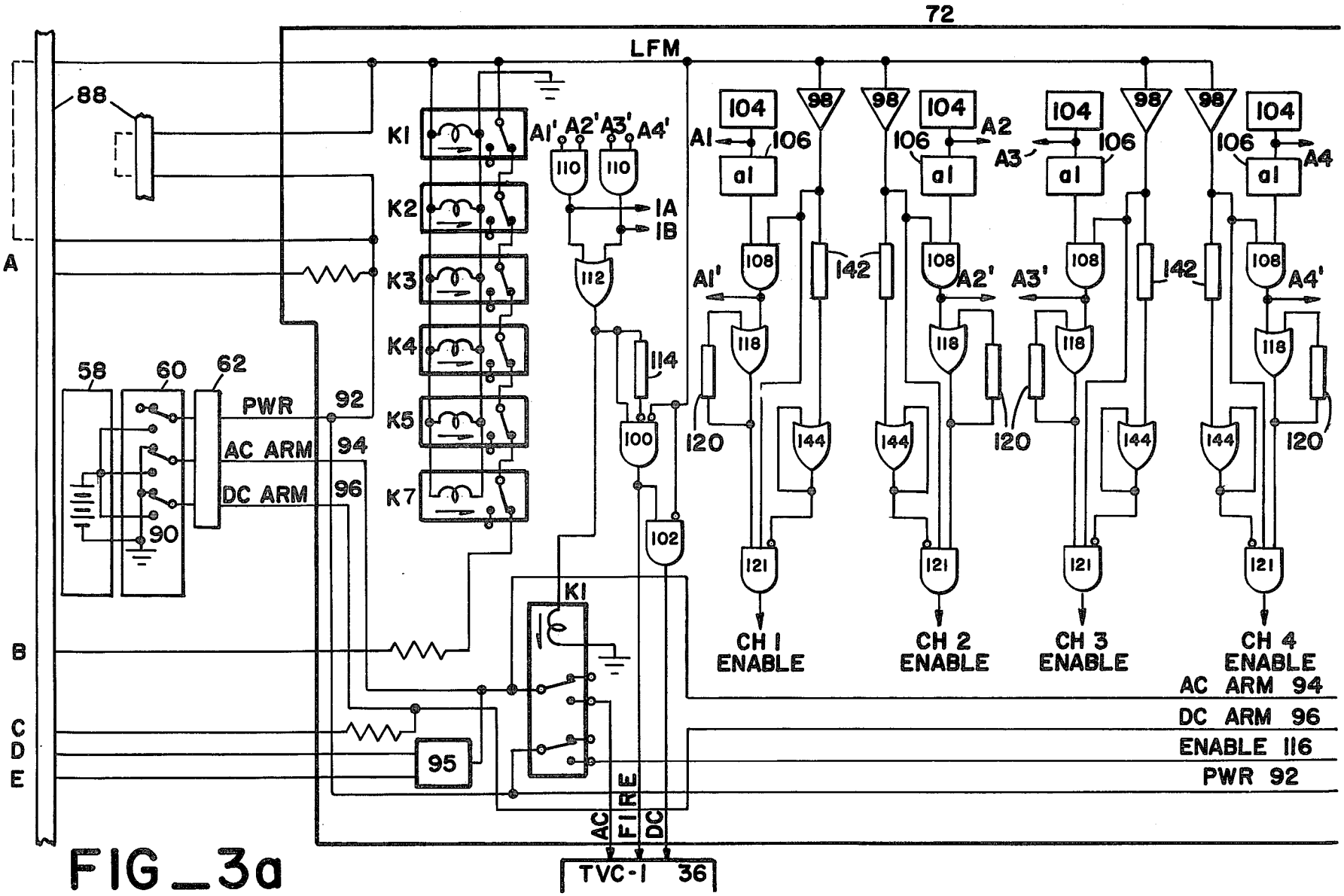
FIG. 3 *a, b, c, d, e* is a schematic of an initiation system using motion-induced stimuli.
Figure 3B:
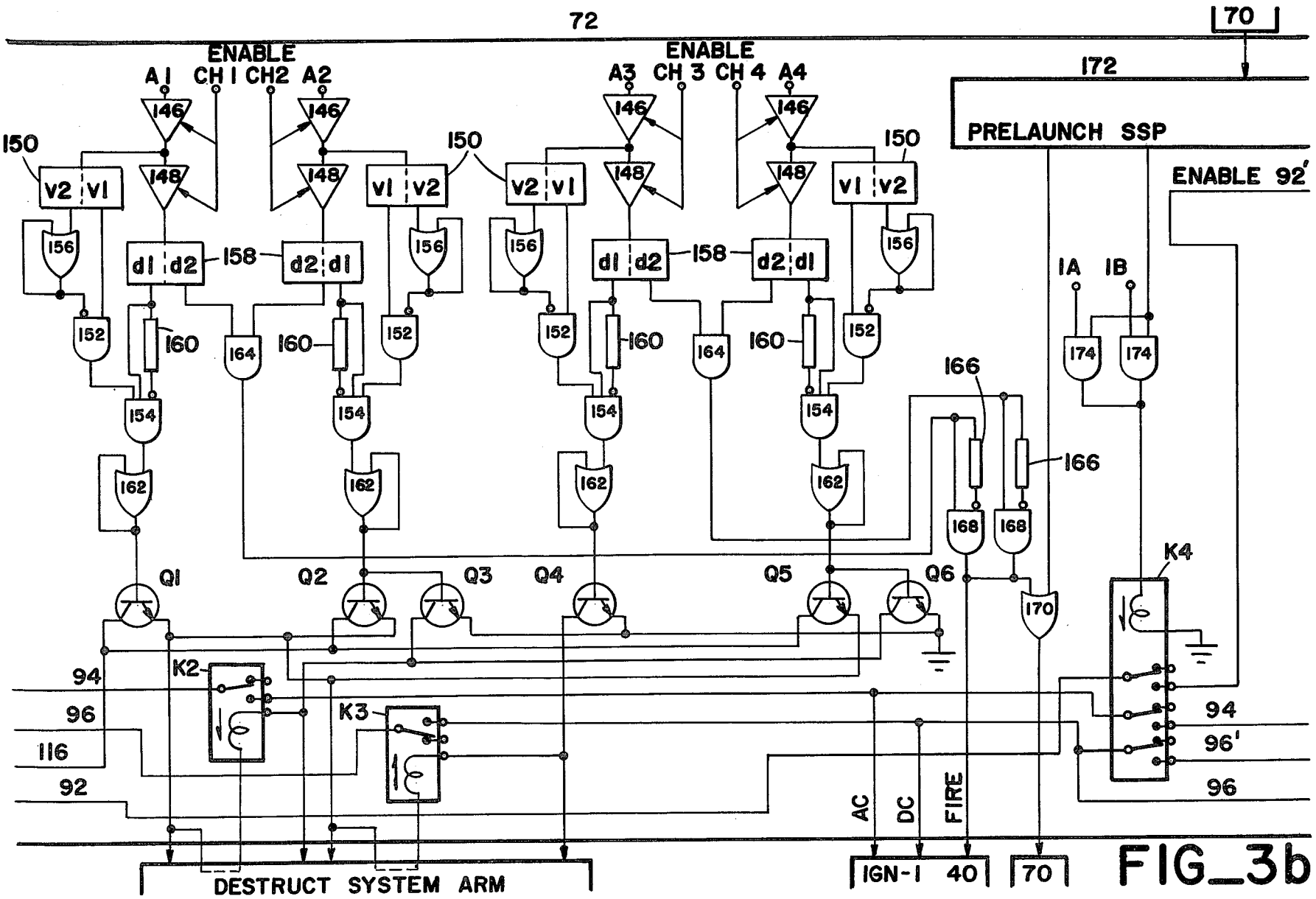
Figure 3C:
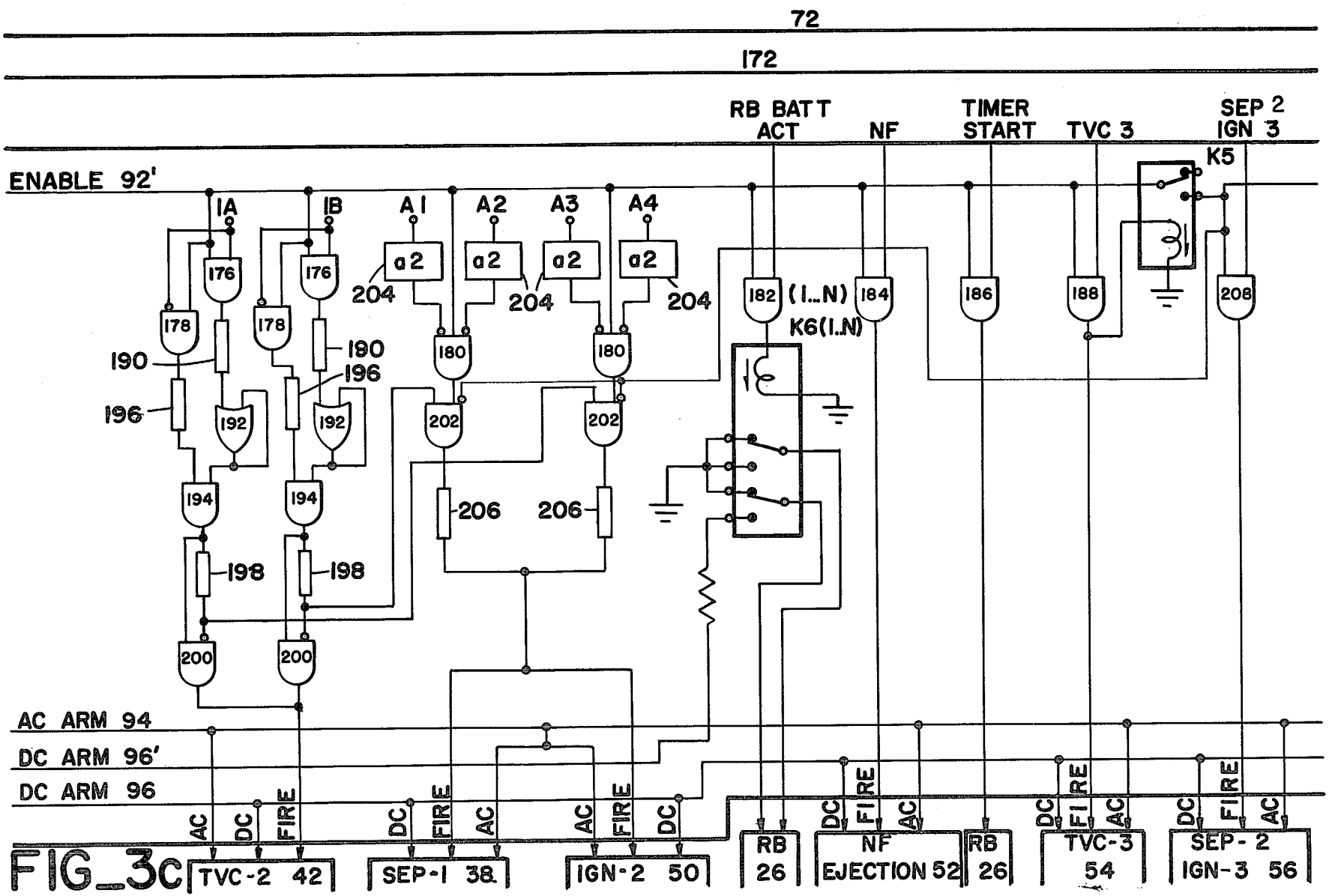
Figure 3D:
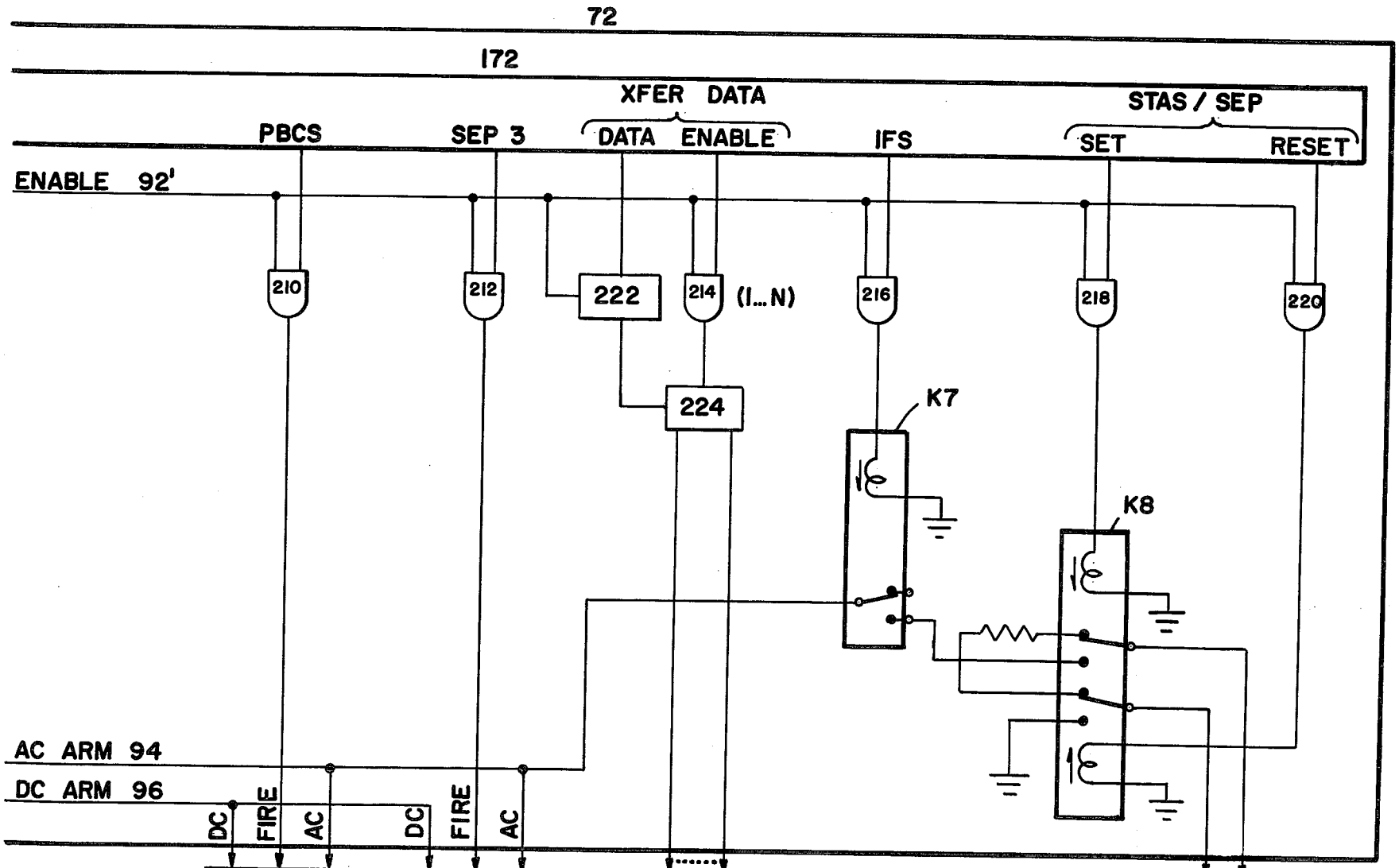
Figures 3E, 4:
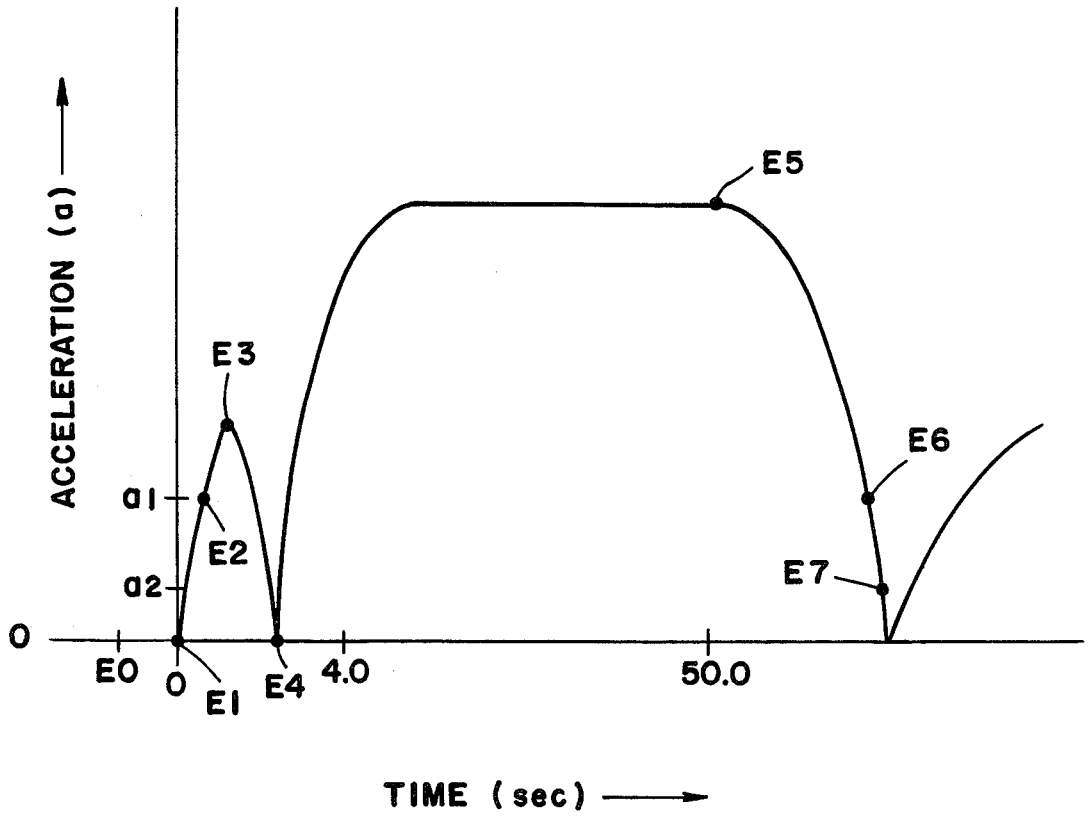
FIG. 4 is a graph of acceleration vs. time for a multi-stage missile flight profile.

FIG. 4 illustrates the relationship of the motion stimuli to missile events as a function of acceleration vs. time. Event EO occurs prior to launch and is a commanded prelaunch signal to initialize the missile. At $t=o$ event E1 occurs when the umbilical disconnects as the missile starts to move. As the missile is propelled by the release of gas under pressure, it achieves acceleration *a*1 where Event 2 occurs, enabling the first stage thrust vector control system. When distance *d*1 has been achieved within the velocity range of *v*1–*v*2, Event 3 occurs to arm the first stage ignition circuits so that when distance *d*2 is achieved the first stage rocket motor ignites as Event 4. All these events must occur prior to $t=4$, or else the first stage rocket motor is never ignited and the missile launch is abortive.

At some time prior to the nominal burnout of the first stage rocket motor, for instance at $t=50$ seconds, Event 5 occurs to enable the next series of events so long as the acceleration is still sat least equal to *a*1. At least 4 seconds later, and when the acceleration is less than *a*1 during first stage tailoff, Event 6 occurs to enable the second stage thrust vector control system. After Event 6 occurs and when the acceleration drops below *a*2, first stage separation occurs and the second stage rocket motor is ignited as Event 7.

Figure 5:
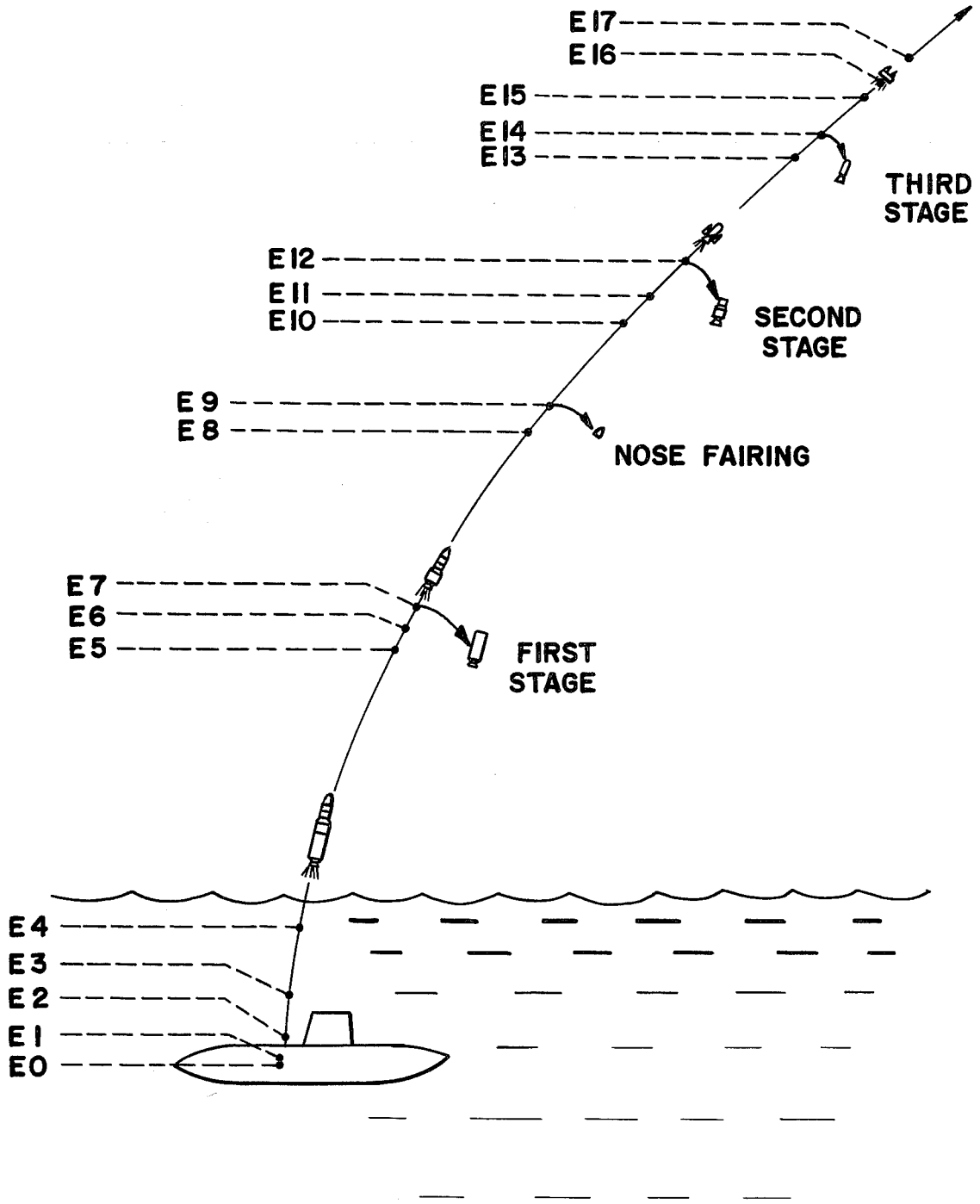
FIG. 5 is an illustration of a multi-stage missile flight profile.

The remaining missile events are commanded and are not a function of motion-induced stimuli. FIG. 5 shows a possible mission profile for a ballistic missile launched from a submerged platform. Events 1-7 have been explained above and are the results of motion-induced stimuli. Event 8 activates the re-entry body batteries while the nose fairing is ejected as Event 9 when the atmosphere has been cleared. Then prior to second stage shutdown the re-entry body timers are started as Event 10 and the third stage thrust vector control is initiated as Event 11. Second stage separation and third stage rocket motor ignition occur as Event 12.

The post boost control system is activated as Event 13 to stabilize the third stage in roll prior to third stage separation. At third stage shutdown Event 14 occurs and the third stage is jettisoned. The equipment section 22 with its re-entry bodies 26 is controlled by the post boost control system to provide proper orientation and incremental velocities for the launch of each re-entry body. Data transfer to the re-entry bodies 26 occurs as Event 15, re-entry body launch is enabled by Event 16, and the re-entry bodies are released as Event 17 to freefall to their designated impact points.

Thus, the present invention provides positive control of a missile flight profile during the early phases of powered flight by using motion-induced stimuli to initiate the various missile pyrotechnic events for maximum reliability of operation and maximum safety for the launch facility and personnel.

What is claimed is:

1. A motion-induced stimuli initiation system for a multi-stage missile comprising:
   (a) a plurality of firing units to initiate respective pyrotechnic events;
   (b) means for obtaining motion-induced stimuli;
   (c) means for computing from said motion-induced stimuli redundant acceleration, velocity and distance data;
   (d) means for combining said redundant acceleration, velocity and distance data to provide valid respective outputs to said firing units should said obtaining means incur a partial failure; and
   (e) means for comparing said redundant data with predetermined values of acceleration, velocity and distance to assure that said missile has attained a nominal velocity and a safe distance from the launch facility within a predetermined time after launch before initiation of arming of destruct system and of igniting a missile engine and to initiate said pyrotechnic events when said values have been attained.

2. A motion-induced stimuli initiation system as recited in claim 1 wherein said obtaining means comprises a plurality of accelerometers mounted on said missile, each of said accelerometers providing a data channel to said computing means.

3. A motion-induced stimuli initiation system as recited in claim 2 wherein said computing means comprises:

(a) a first integrator to integrate the acceleration data from one of said accelerometer data channels to obtain velocity;

(b) a second integrator to integrate the velocity data from said first integrator to obtain distance;

(c) a first comparator to compare said acceleration data to a first predetermined acceleration value and provide an output when said acceleration data equals or exceeds said first predetermined acceleration value;

(d) a second comparator to compare said velocity data to two predetermined velocity values and to provide an output when said velocity data is in the range between said two predetermined velocity values; and (e) a third comparator to compare said distance data from said second integrator to a predetermined distance value and provide an output when said distance data equals or exceeds said predetermined distance value.

4. A motion-induced stimuli initiation system as recited in claim 3 wherein said combining means comprises a solid state voting logic circuit to which is input said redundant acceleration, velocity and distance data such that should two of said data channels attain said predetermined values for said redundant acceleration, velocity and distance data a valid output is provided to said respective firing units.

* * * * *